US008403060B2

(12) United States Patent
Given et al.

(10) Patent No.: US 8,403,060 B2
(45) Date of Patent: Mar. 26, 2013

(54) WELLHEAD TREE PRESSURE LIMITING DEVICE

(75) Inventors: Michael J. Given, Cypress, TX (US); Neil J. Scott, Stonehaven (GB); William D. Munro, Aberdeen (GB)

(73) Assignee: Vetco Gray Inc., Houston, TX (US)

( * ) Notice: Subject to any disclaimer, the term of this patent is extended or adjusted under 35 U.S.C. 154(b) by 0 days.

(21) Appl. No.: 13/412,226

(22) Filed: Mar. 5, 2012

(65) Prior Publication Data

US 2012/0160512 A1 Jun. 28, 2012

Related U.S. Application Data

(62) Division of application No. 12/846,379, filed on Jul. 29, 2010, now Pat. No. 8,322,443.

(51) Int. Cl.
*E21B 34/02* (2006.01)

(52) U.S. Cl. ..... 166/368; 166/344; 166/311; 166/373; 166/179

(58) Field of Classification Search ..... 166/368, 166/338, 339, 344, 347, 311, 373, 381, 386, 166/179, 147, 188, 191, 192; 251/205, 208, 251/209; 137/565.23
See application file for complete search history.

(56) References Cited

U.S. PATENT DOCUMENTS 3,194,533 A * 7/1965 McLay ..... 251/122
4,566,722 A * 1/1986 Huber et al. ..... 285/18
4,943,187 A * 7/1990 Hopper ..... 405/190
5,553,667 A * 9/1996 Budde et al. ..... 166/70
5,787,979 A * 8/1998 Giroux et al. ..... 166/177.4
5,813,457 A * 9/1998 Giroux et al. ..... 166/153
5,868,204 A * 2/1999 Pritchett et al. ..... 166/368
5,884,706 A * 3/1999 Edwards ..... 166/335
5,988,282 A * 11/1999 Jennings et al. ..... 166/348
6,050,339 A * 4/2000 Milberger ..... 166/368
6,056,053 A * 5/2000 Giroux et al. ..... 166/155
6,394,131 B1 * 5/2002 Fross et al. ..... 137/614.05
6,450,263 B1 * 9/2002 Schwendemann ..... 166/373
6,715,555 B2 * 4/2004 Milberger et al. ..... 166/368
6,736,012 B1 * 5/2004 Beall et al. ..... 73/709
6,763,891 B2 * 7/2004 Humphrey et al. ..... 166/368
6,966,383 B2 * 11/2005 Milberger et al. ..... 166/368
7,025,132 B2 * 4/2006 Kent et al. ..... 166/87.1
7,051,804 B1 * 5/2006 Arning ..... 166/97.1
7,134,851 B2 * 11/2006 Chenoweth ..... 417/571
7,159,669 B2 1/2007 Burgoyne et al.
7,325,598 B2 * 2/2008 Bartlett ..... 166/75.13

(Continued)

OTHER PUBLICATIONS

Search Report from corresponding GB Application No. GB1112557.2 dated Oct. 27, 2011.

(Continued)

*Primary Examiner* — Matthew Buck
(74) *Attorney, Agent, or Firm* — Bracewell & Giuliani LLP

(57) ABSTRACT

A pressure relief device is used to relieve pressure in a void within a wellhead housing. In one embodiment, the pressure relief device includes a plunger having a stepped plug, wherein the plug can be fully open to allow flow from the void, restricted to allow a predetermined flow to relieve pressure, or closed to prevent flow from the void. In another embodiment, the pressure relief device includes a vacuum puller that creates negative pressure in a vessel. As fluid in the void expands, it is able to enter the space formerly occupied by the plunger. In yet another embodiment, a rupture disc is used to prevent fluid from flowing from the void, through a passage, to the wellbore. If pressure in the void exceeds a predetermined value, the rupture disc yields and allows the trapped fluid to flow to the wellbore.

13 Claims, 5 Drawing Sheets

U.S. PATENT DOCUMENTS

| | | | | |
|---|---|---|---|---|
| 7,909,103 | B2 * | 3/2011 | Fenton | 166/348 |
| 7,938,189 | B2 * | 5/2011 | Rytlewski | 166/337 |
| 8,066,075 | B2 * | 11/2011 | Cowie et al. | 166/344 |
| 2003/0019632 | A1 * | 1/2003 | Humphrey et al. | 166/368 |
| 2008/0230229 | A1 | 9/2008 | Shaw et al. | |
| 2009/0071656 | A1 | 3/2009 | Shaw et al. | |

OTHER PUBLICATIONS

Office Action issued on Jan. 18, 2012 in U.S. Appl. No. 12/846,379.

* cited by examiner

WELLHEAD TREE PRESSURE LIMITING DEVICE

RELATED APPLICATION

This application is a divisional of and claims priority to and benefit of U.S. patent application Ser. No. 12/846,379, filed on Jul. 29, 2010, titled "Wellhead Tree Pressure Limiting Device" incorporated by reference in its entirety.

BACKGROUND OF THE INVENTION

1. Field of the Invention

The present invention relates in general to a method and apparatus to relieve trapped pressure in a wellhead and in particular to a pressure relief device for relieving pressure from a void located between two crown plugs in a wellhead.

2. Brief Description of Related Art

A horizontal subsea tree has production outlet extending generally horizontally, in relation to the wellbore, and a bore that is axially aligned with the wellbore. A tubing hanger lands in the horizontal tree and supports a string of tubing extending into the wellbore. The tubing hanger has a vertical passage and a lateral passage extending from the vertical passage and registering with the production outlet of the tree. In some installations an internal tree cap lands in the tree above the tubing hanger, the tree cap normally having a vertical passage that aligns with the vertical passage in the tubing hanger. As a dual safety barrier, a wireline deployed crown plug is installed in the vertical passage of the tubing hanger and another crown plug is installed in the vertical passage of the tree cap. In other installations, the internal tree cap is omitted. In that case, the vertical passage of the tubing hanger is typically plugged with two crown plugs to meet requirements of having dual safety barriers.

Fluid, such as, for example, wellbore fluid, may be trapped in the vertical passage between the two plugs. The fluid may be relatively cold when it is trapped because the subsea temperature is relatively cold. During well production, the fluid flowing from the depths of the earth is relatively warm and subsequently heats the subsea wellhead. As the fluid trapped between the crown plugs expands, it may cause damage to the integrity of the crown plugs. It is thus desirable to relieve the pressure from the void between the crown plugs, without releasing the well fluid into the sea.

SUMMARY OF THE INVENTION

A pressure relief device may be used to relieve the pressure that can occur, for example, in the void created between two crown plugs in a subsea tree. A passage through the tree or the crown plug itself can establish fluid communication between the void and the pressure relief device. In one embodiment, the pressure relief device includes a restriction valve. The restriction valve may have, for example, a stepped plug. The stepped plug can have a conical sealing surface and a shoulder, wherein the plug can be in a first position wherein it is fully opened to allow fluid to flow freely through the valve. In a second position, the shoulder creates a small gap between an orifice of the fluid passage and the shoulder. The shoulder thus restricts the flow to be less than or equal to a predetermined rate. In a third position, a sealing surface on the plug engages a seat in the fluid passage, thus stopping flow through the passage. In some embodiments, an expansion vessel may be located downstream from the pressure relief device, thus collecting fluid that is released through the pressure relief device.

In another embodiment, the passage is in fluid communication with a vacuum puller. The vacuum puller may include a body having an interior cavity and a plunger occupying a portion of space within the cavity. After the crown plugs are set, a remotely operated vehicle can retract the plunger within the cavity. The cavity is sealed, so that the plunger is retracted, it creates additional volume greater or equal to the expected expansion of the fluid between the crown plugs. The negative pressure in the cavity allows the fluid to occupy the additional volume. Negative pressure is pressure that is lower than the pressure outside the cavity. In the event that fluid between the crown plugs expands, the excess fluid is able to flow through the passage and into the vacuum puller cavity. As a result of the negative pressure, the additional volume in the vacuum puller can thus be filled by the excess fluid from the void between the plugs.

In yet another embodiment, the void between the plugs is in fluid communication with a passage through one of the plugs. The passage can terminate between the seals of a bi-directional packing set. A rupture disc can be located on an interior surface of the crown plug, such that the rupture disc prevents fluid from flowing into the passage. In the event that wellbore fluid in the cavity expands, the increased pressure causes the rupture disc to rupture and thus allow fluid to flow through the passage, between the seals of the bi-directional packing set, and into the wellbore.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

Figure 1:
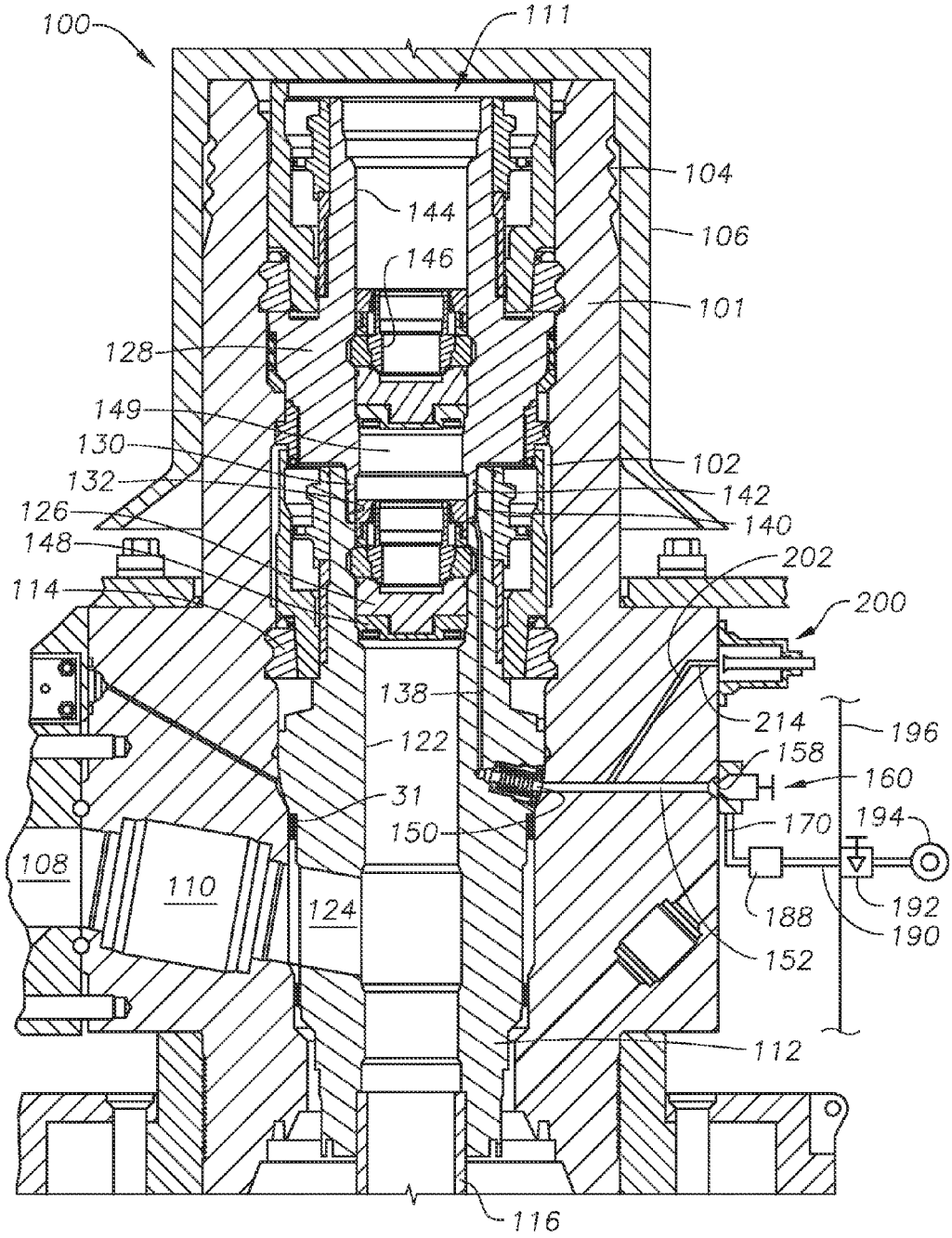
FIG. 1 is a sectional view of a subsea horizontal tree having two exemplary embodiments of a pressure relief device.

Referring to FIG. 1, Christmas tree 100 is of a type known as a horizontal tree. It has a tree block 101 with a vertical or axial tree bore 102 extending completely through it. A set of grooves 104 is located on the exterior near the upper end for connection to a drilling riser (not shown). A removable corrosion cover 106 fits over the upper end of tree 100. Tree 100 has a lateral production passage 108 that extends generally horizontally from bore 102 and is controlled by a valve 110. Tree 100 will be landed on top of a wellhead housing (not shown), which supports casing extending into a well.

The tree 100 has an inner wellhead assembly 111 housed within the axial bore 102 of the tree 100. A tubing hanger 112 lands sealingly in bore 102. Tubing hanger 112 is secured to tree 100 by a lock down mechanism 114. A string of production tubing 116 extends through the casing hangers (not shown) into the well for the flow of production fluid. Production tubing 116 is secured to tubing hanger 112 and communicates with a vertical passage 122 that extends through tubing hanger 112. A lateral passage 124 extends from vertical passage 122 and aligns with tree lateral passage 108.

A lower wireline retrievable plug 126, or crown plug, will lock in vertical passage 122 above lateral passage 124, sealing the upper end of vertical passage 122. Seals can form a seal between plug 126 and tubing hanger 112, and dogs, or other types of locking devices, may be used to lock plug 126 in place.

In this example, a tree cap 128 inserts sealingly into tree bore 102 above tubing hanger 112. Tree cap 128 has a downward depending isolation sleeve 130 that is coaxial. Sleeve 130 fits within a receptacle 132 formed on the upper end of tubing hanger 112. A passage 138 within tubing hanger 112 communicates with a vent port 140 located at the interface between sleeve 130 and receptacle 132. Seals 142 located on sleeve 130 seal to receptacle 132 above vent port 140. The interior of sleeve 130 communicates with an axial passage 144 that extends through tree cap 128. Axial passage 144 has approximately the same inner diameter as tubing hanger passage 122. A radial port 150 in tubing hanger 112 communicates the exterior of tubing hanger 112 with passage 138, which extends upward through tubing hanger 112. Passage 152 can be in communication with radial port 150, and, thus, passage 152 can be in communication with passage 138.

An upper wireline retrievable crown plug 146 inserts into tree cap passage 144. Metal seal 148 on crown plug 146 engages a surface in passage 144. Dogs, or other types of locking mechanisms, can be used to lock upper crown plug 146 in place. Upper crown plug 146 is a redundant plug for further sealing passage 144, the primary seal being formed by lower plug 126. Upper crown plug 146 and lower plug 126, thus, form dual safety barriers against gas or liquids that may pass up through vertical passage 122. Any type of upper and lower plug can be used to form such safety barriers.

Void 149 is a cavity having a circumference defined by passage 144 and ends defined by lower plug 126 and seal 148 of crown plug 146. Void 149 may also include the volume associated with bores or recesses on the top of lower plug 126 or the bottom of crown plug 146. Void 149 is in fluid communication with vent port 140 and thus passage 138.

Figure 2:
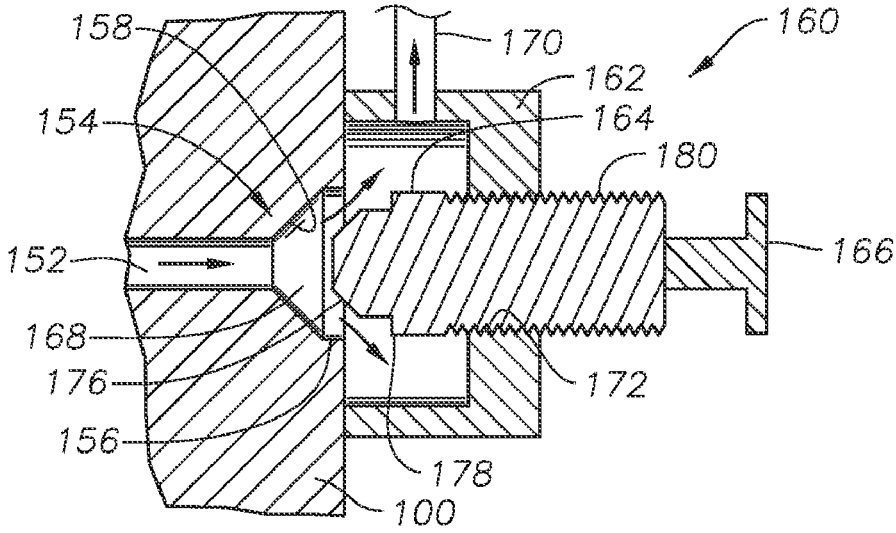
FIG. 2 is a sectional view of a restriction valve embodiment of a pressure relief device, the restriction valve being in an open position.

Referring to FIG. 2, in one embodiment, passage 152 leads from port 150 (FIG. 1) through tree 100 to tree port 154. Tree port 154 is an orifice on an exterior surface of tree 100, which thus forms an outlet for passage 152. Tree port 154 may have its maximum inner diameter 156 at the surface of tree 100. Recessed from the surface of tree 100 is sealing surface 158. In one embodiment, sealing surface 158 is a conical annular seat having a sloped surface, or counterbore, that tapers inward as it transitions further into the recess, away from the exterior surface of tree 100. In one embodiment, tree port 154 is machined directly into the body of tree 100. In another embodiment, tree port 154 may be attached to tree 100, either permanently or detachably, such that tree port 154 is in fluid communication with passage 152.

Restriction valve 160 is a pressure relief mechanism that may be connected to tree port 154. The connection may be detachable or permanent. In one embodiment, restriction valve 160 and tree port 154 are integrally formed as a single unit for connecting to tree 100. Referring to FIG. 2, restriction valve 160 includes valve body 162, stepped plug 164, and handle 166. Valve body 162 can have an inlet port 168 and an outlet port 170. As will be described, below, outlet port 170 may be connected to tubing for containing and removing the fluid. Inlet port 168 is an orifice that generally aligns with tree port 154 when restriction valve 160 is connected to tree 100. Inlet port 168 may be an annular orifice having an outer diameter the same as or greater than inner diameter 156 of tree port 154. Threaded orifice 172 may pass through a surface of valve body 162. In one embodiment, threaded orifice 172 is on the opposite side of body 162 from port 154 and is axially aligned with port 154.

Stepped plug 164 is a cylindrical shaft having a conical sealing surface 176. Sealing surface 176 has a taper that generally matches the taper of sealing surface 158. Stepped plug 164 also has shoulder 178. Shoulder 178 has an outer diameter greater than the largest outer diameter of seat surface 164. Shoulder 178 may be axially spaced apart from sealing surface 176, and thus separated by a portion of stepped plug 164 having a constant outer diameter. Alternatively, shoulder 178 may be adjacent to sealing surface 176. Handle 166 is connected to stepped plug 164. In one embodiment, handle 166 may be rotated by a remotely operated vehicle ("ROV") (not shown). In another embodiment, handle 166 may be rotated by a motor (not shown) or a tool (not shown).

The body of stepped plug 164 may have threads 180 for threadingly engaging threads 172 of valve body 162. Threads 180 cause stepped plug 164 to move toward or away from tree 100 when handle 166 is rotated.

With stepped plug 164 in its open position, as shown in FIG. 2, a gap is formed between stepped plug 164 and both sealing surface 158 and tree port outer diameter 156. Flow from passage 152, thus, is able to pass through valve body 162 to outlet port 170.

Figure 3:
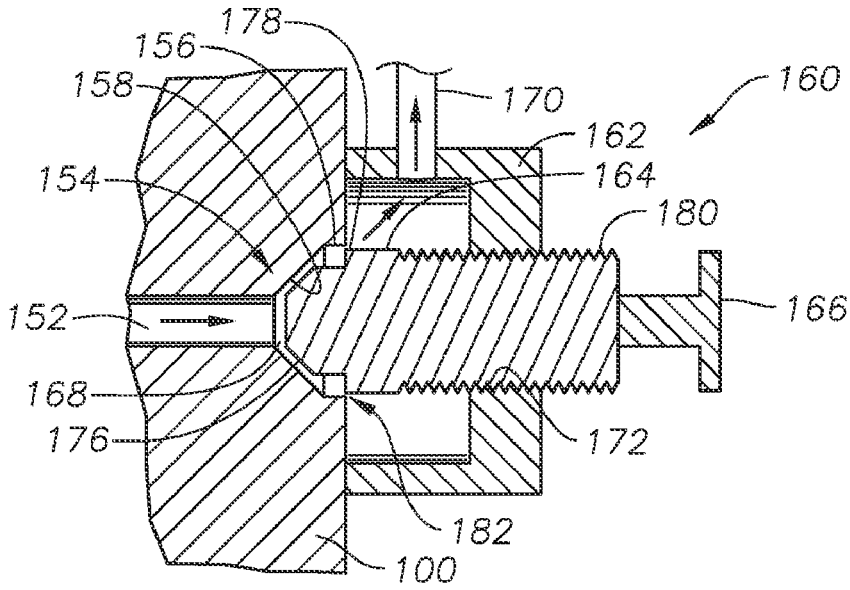
FIG. 3 is a sectional view of the restriction valve embodiment of FIG. 2, showing the restriction valve in a restricted position.

Referring to FIG. 3, with stepped plug 164 in its restricted position, shoulder 178 is located near inner diameter 156. The outer diameter of shoulder 178 is slightly smaller than inner diameter 156 of tree port 154, thus forming a predetermined gap 182 between shoulder 178 and inner diameter 156. Sealing surface 176 is spaced axially apart from sealing surface 158. Flow from passage 152 may pass through predetermined gap 182, but the flow rate is restricted. Indeed, the flow rate when stepped plug 164 is in its restricted position is much lower than the flow rate when stepped plug 164 is in its open position. In some embodiments, gap 182 is sized to maintain a restricted flow rate that is less than a predetermined value for a given fluid type, viscosity, and temperature.

Figure 4:
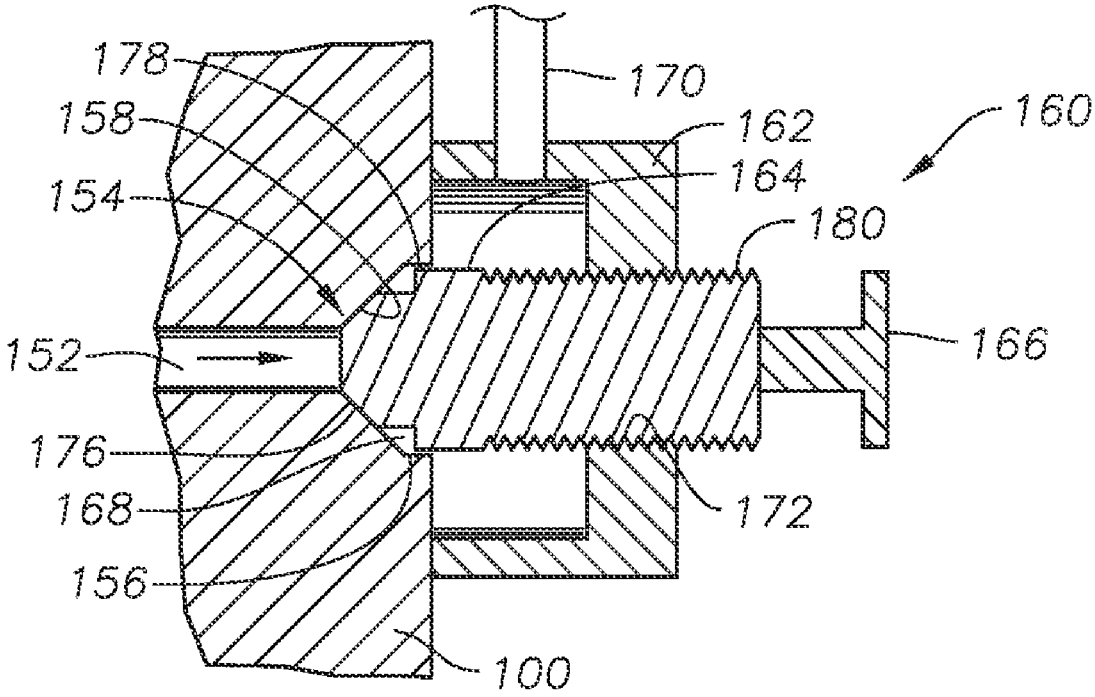
FIG. 4 is a is a sectional view of the restriction valve embodiment of FIG. 2, showing the restriction valve in a closed position.

Referring to FIG. 4, with stepped plug 164 in its closed position, sealing surface 176 is in sealing contact with sealing surface 158. Fluid from passage 152 is not able to pass through tree port 154.

Referring back to FIG. 1, in one embodiment, outlet port 170 of restriction valve 154 is in fluid communication with expansion vessel 188. Expansion vessel 188 may be a container having, for example, a cylindrical shape. The volume of expansion vessel 188 may be any volume. In one embodiment, the volume of expansion vessel 188 is a fixed volume. In another embodiment, the volume of expansion vessel 188 can expand and contract in response to internal or external pressure. In one embodiment, the volume of expansion vessel 188 equals the volume of void 149. Alternatively, the volume of expansion vessel 188 may be determined by the thermal expansion volume ("TEV") associated with void 149 and the bulk modulus of the fluids filling 188. TEV=V2−V1, where V1 equals the volume of a given fluid in void 149 at a first temperature. V2 equals the volume of the given fluid when the temperature changes to a second temperature. TEV, thus, is the amount of excess fluid that must be removed from void 149 after the temperature changes from the first temperature to the second temperature. Still referring to FIG. 1, expansion vessel 188 may be connected, via tube 190, to needle valve 192, which can be a conventional needle valve. Needle valve 192, in turn, may be connected to hot stab 194. In one embodiment, needle valve 192 can be actuated by an ROV. Hot stab 194 can be a conventional connection for connecting a tube to collect fluid via tube 190. Thermal insulation 196 may cover a substantial portion of tree 100. Various components, including expansion vessel 188 and restriction valve 160 may be covered by thermal insulation 196. The fluid in expansion vessel 188 may be a liquid or a gas. In some embodiments, the fluid may include compressible solids.

In operation, stepped plug 164 of restriction valve 160 may be in the open position of FIG. 2 when crown plug 146 is placed in tree 100. Likewise, needle valve 192 may also be open, and a tube (not shown) may be connected to hot stab 194 when crown plug 146 is set. As crown plug 146 moves downward, it applies pressure to fluid in and above void 149; the excess fluid will pass through passage 138 to passage 152, and then through restriction valve 160, expansion vessel 188, and needle valve 192 to hot stab 194. The excess fluid can be removed through the tube (not shown) connected to hot stab 194. An ROV (not shown), for example, can remove the excess fluid.

After crown plug 146 is set in place, an ROV (not shown) may rotate handle 166 to move stepped plug 164 to its restricted position shown in FIG. 3. In the event that fluid in void 149 expands, such as due to thermal expansion, the pressure of the fluid will cause the fluid to pass through gap 182 between shoulder 178 and inner diameter 156 of tree port 154. The excess fluid may be contained in expansion vessel 188 (FIG. 1). In the event needle valve 192 is open, the excess fluid may be removed via hot stab 194.

Still referring to FIG. 1, in an alternative embodiment, the pressure relief mechanism may be vacuum puller 200, which may be located on an exterior surface of tree 100 and in fluid communication with void 149. Vacuum puller may be connected via negative pressure passage 202 to passages 152 and 138, as shown in FIG. 1, or it may be connected by other passages (not shown). Indeed, vacuum puller 200 may be located anywhere on tree 100, provided it has fluid communication with void 149.

Figure 5:
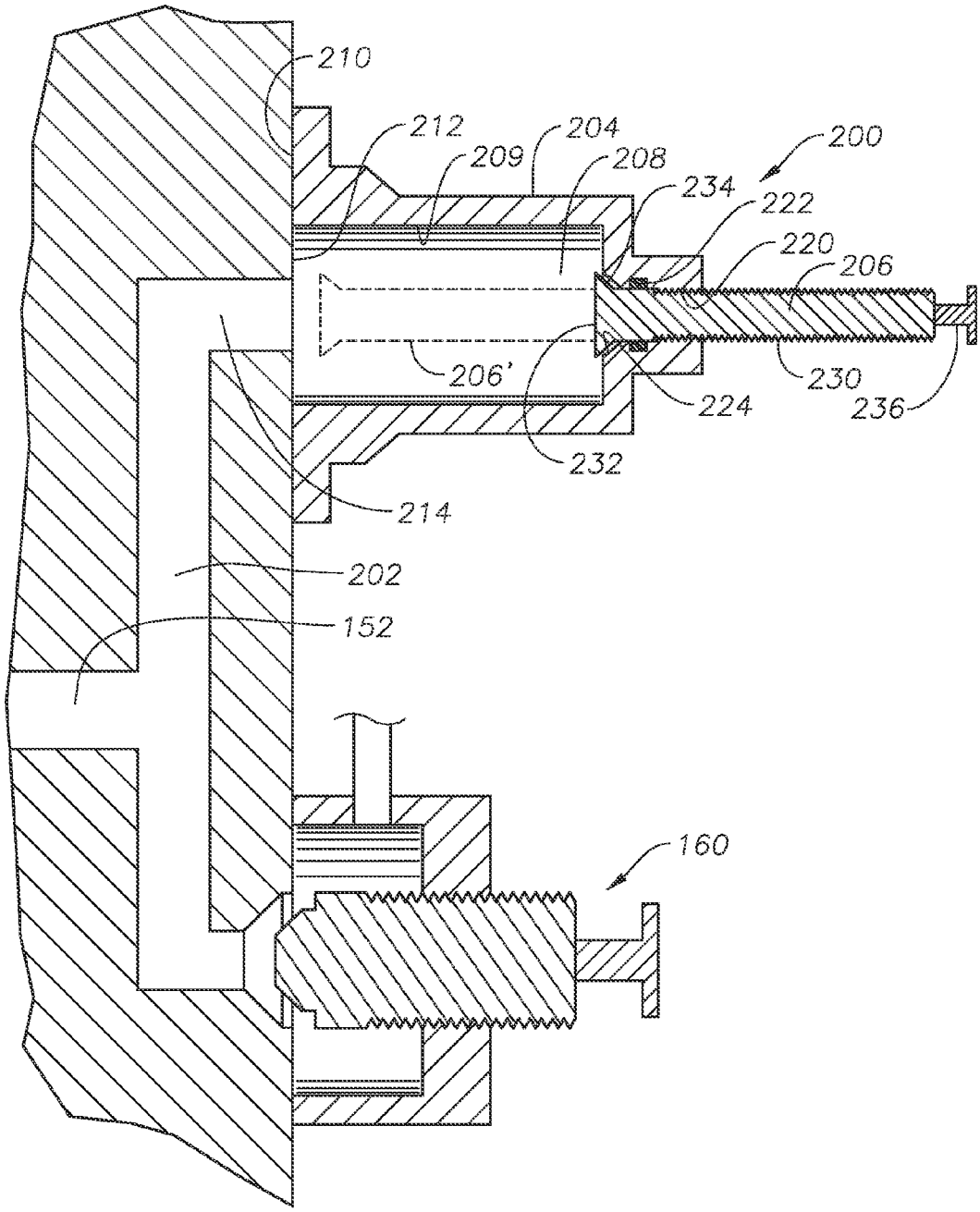
FIG. 5 is a sectional view of a vacuum puller embodiment of a pressure relief device.

Referring to FIG. 5, vacuum puller 200 may be used with conventional "between the plugs" ("BPT") valve (not shown) or with stepped valve 160. Vacuum puller 200 includes vacuum body 204 and plunger 206. Vacuum body 204 has an interior cavity 208 defined by walls 209 of body 204. Sealing surface 210 is formed at one end of vacuum puller 200 for sealing against an exterior surface 212 of tree 100. In one embodiment, the base of vacuum body 206 is open near sealing surface 212. When vacuum body 204 is attached to tree 100, exterior surface 212 of tree 100 defines one side of cavity 208 within vacuum body 204. In another embodiment (not shown), vacuum body 204 completely encloses cavity 208.

Port 214 of tree 100 is an aperture through surface 212 and is in fluid communication with passage 202. When vacuum body 204 is connected to tree 100, port 214 is in communication with cavity 208. Sealing surface 210 thus surrounds port 214.

Threaded opening 220 is a threaded aperture through body 204. Seal 222, an annular seal, may be located on the inner diameter of threaded opening 220. Threaded opening 220 may have a counter bore 224 facing the interior of body 204. Counter bore 224 may have a smooth, tapered surface suitable for forming a seal.

Plunger 206 is a cylindrical shaft. A portion of the outer diameter of plunger 206 has threads 230 for engaging the threads of threaded opening 220. One end of plunger 206 may have plug 232. Plug 232, which may be an integral portion of plunger 206, has an outer diameter that is wider than the outer diameter of the shaft of plunger 206, and thus wider than the inner diameter of threaded opening 220. The outer diameter of plug 232 is less than the inner diameter of valve body 204 in this embodiment. Plug 232 can have a tapered surface 234 wherein the outer diameter of plug 232 becomes smaller when moving toward the threaded portion of plunger 206. Tapered surface 234 may have a taper similar to the taper of counter bore 224, and thus may form a seal against counter bore 224. Handle 236 may be located on the opposite end of plunger 206 from plug 232. Handle 236 may be operable by an ROV (not shown), and electric motor (not shown) or any other actuation technique.

Plunger 206 is installed in body 204 such that a substantial portion of plunger 206 is located within cavity 208 when advanced forward, as shown by the dashed line 206' in FIG. 5. Vacuum puller 200 is then sealingly attached to tree 100 such that cavity 208 is in communication with port 214. All or a portion of vacuum puller 200 may be covered by insulation 196.

During wellhead completion, crown plug 146 is set and sealed in tree cap 128, thus creating void 149. A vent valve such as, for example, a conventional back pressure transducer ("BPT") valve or stepped valve 160 may be opened to allow excess fluid to move out of void 149 when crown plug 146 is set. After setting and sealing crown plug 146 in tree cap 128, any vent valves in communication with void 149 are closed. After sealing crown plug 146 and closing vent valves or stepped valve 160, an ROV may rotate handle 236 to retract plunger 206 in cavity 208. Plunger 206 creates negative pressure as it is substantially withdrawn from cavity 208. Seal 222 forms a seal against the shaft of plunger 206 to prevent sea water from entering cavity 208. In one embodiment, plug 232 forms a seal against counterbore 224 to further prevent sea water from entering cavity 208. Furthermore, the seal between the base of body 204 and sealing surface 210 of tree 100 prevents sea water from entering cavity 208. Thus, the only point of entry to fill the negative space created by the retraction of plunger 206 is through port 214, and thus through passage 202. Vacuum puller 200 may be used with or without restriction valve 160.

In the event that fluid in void 149 expands, such as from thermal expansion, the excess volume of fluid may migrate through passage 138, passage 152, passage 202, and port 214 to cavity 208. The additional fluid capacity of vacuum puller 200 to accept this fluid is roughly equal to the volume of plunger 206 that is withdrawn from cavity 208.

Figure 6:
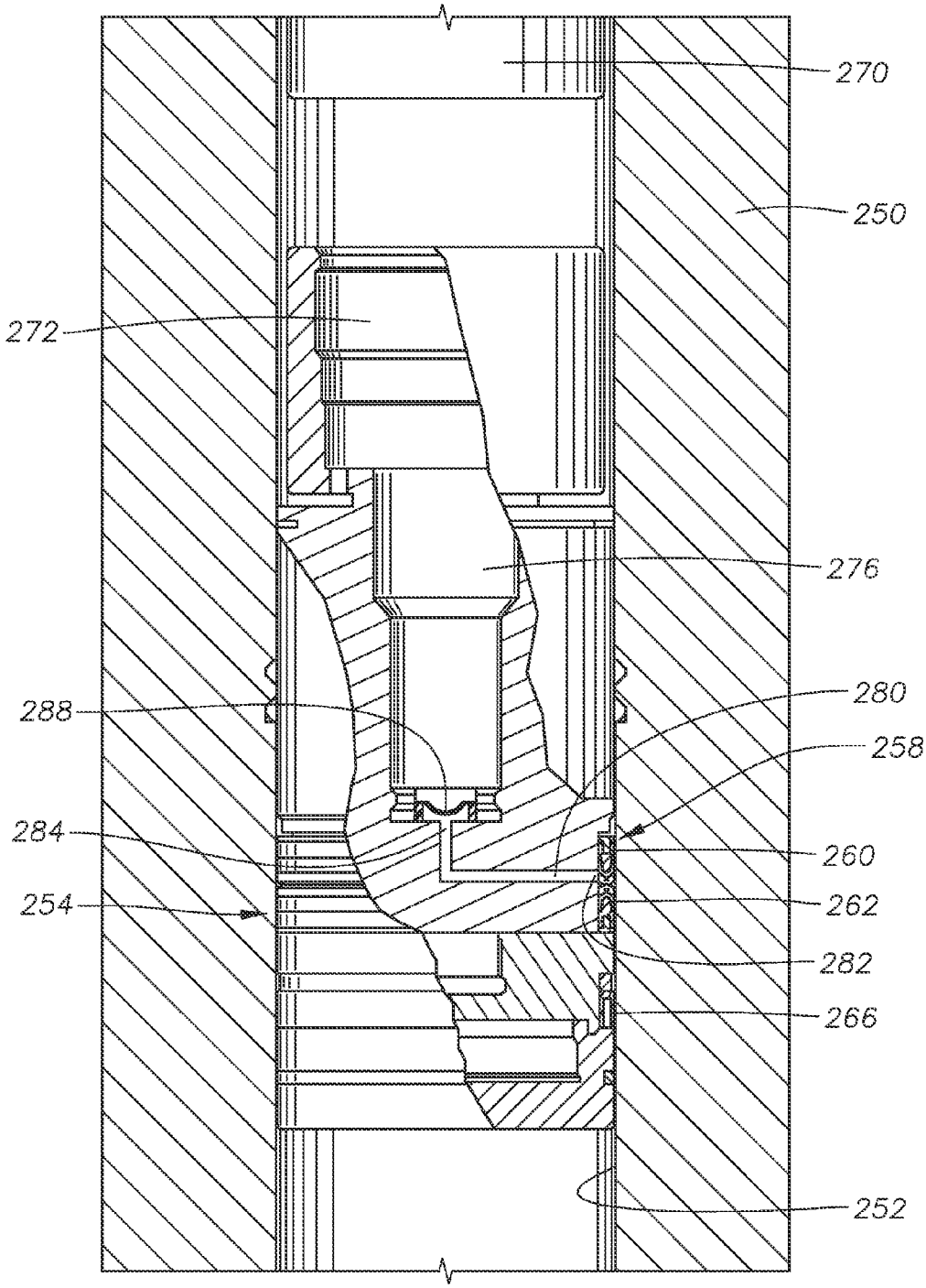
FIG. 6 is a sectional view of a rupture disc embodiment of a pressure relief device.

Referring to FIG. 6, in an alternative embodiment, the pressure relief mechanism vents excess fluid into the wellbore. Tubing hanger 250 is located in a subsea horizontal tree (not shown). Tubing hanger 250 has an axial passage 252 that may be obstructed by lower crown plug 254.

Lower crown plug 254 is located within axial passage 252 of tubing hanger 250 to stop the upward flow of wellbore fluid from the wellbore (not shown). Lower crown plug 254 will be located above the lateral flow passage (not shown) of tubing hanger 250. Bidirectional packing set ("BPS") 258 is a seal that can form a seal between an outer diameter of lower crown plug 254 and an inner diameter of axial passage 252. BPS 258 includes one upward facing chevron seal set 260 and one downward facing chevron seal set 262. BPS 258 forms a seal between crown plug 254 and tubing hanger 250. In one embodiment, upward facing seal 260 prevents fluid from moving downward between tubing hanger 250 and crown plug 254. Similarly, downward facing chevron seal set 262 prevents fluid from flowing upward between tubing hanger 250 and crown plug 254.

Similarly, u-seal 266 forms a seal between lower plug 254 and tubing hanger 250. U-seal 266 is typically located below BPS 258 and its legs extend downward. In one embodiment, u-seal 266 acts as a check valve wherein pressurized fluid located above u-seal 266 is able to push past u-seal 266 and thus move toward the wellbore (not shown), provided that the pressurized fluid has sufficient pressure. U-seal 266 does not, however, allow fluid from below plug 254 to move upward past u-seal 266. Indeed, increased pressure in the wellbore causes the downward-facing legs of u-seal 266 to expand and thus engage with greater force bore 252 of tubing hanger 250 and the outer diameter of crown plug 254.

Upper crown plug 270 is also sealingly installed in axial passage 252 of tubing hanger 250. In one embodiment, upper crown plug 270 is installed such that it seals off axial passage 252 of tubing hanger 250. In the example shown, there is no internal tree cap, such as tree cap 128 (FIG. 1). However, one could be employed, in which case upper crown plug 270 would be located in the axial passage of the internal tree cap. Like lower crown plug 254, upper crown plug 270 prevents fluid from flowing upward through the bore of tree cap 252. Void 272 is the space between upper crown plug 270 and lower crown plug 254. The circumference of void 272 may be defined by bore 252 of tubing hanger 250. Void 272 may also include recess 276 of lower crown plug 254. Indeed, void 272 can include any space in which fluid may be trapped between upper crown plug 270 and lower crown plug 254.

Vent passage 280 is a passage through the body of lower crown plug 254. In one embodiment, vent passage 280 includes a vertical portion and a lateral portion, the vertical portion being substantially parallel to the axis of lower crown plug 254 and the lateral portion being substantially perpendicular to the axis of lower crown plug 254. Passage 280 terminates at port 282. In one embodiment, port 282 is on an outer diameter of lower crown plug 254, and is axially located between upward chevron seal set 260 and lower chevron seal set 262.

Passage 280 has an inlet 284 located on an interior surface of lower crown plug 254. Passage 280, thus, is in fluid communication with void 272. Rupture disc 288, however, may block the fluid communication. Rupture disc 288 is a disc that normally prevents fluid from flowing through an orifice. In one embodiment, rupture disc 288 is located on an interior surface of lower crown plug 254 and positioned to sealingly engage inlet 284. Rupture disc 288 may be located anywhere that it can suitably block fluid from flowing through vent passage 280. Rupture disc 288 can, for example, be located in an orifice at inlet 284, as shown in FIG. 6. Alternatively, rupture disc 288 may be located within passage 280 or at port 282.

Rupture disc 288 prevents fluid from flowing through passage 280 unless the fluid pressure on disc 288 exceeds a predetermined value. In the event the pressure exceeds the pre-determined maximum allowable value, rupture disc 288 will yield and allow fluid to flow past it. The maximum allowable pressure may be selected based on the specifications of the wellhead members. In one embodiment the maximum allowable pressure is set below the pressure at which damage to or catastrophic failure of the wellhead may occur. In one embodiment, rupture disc 288 has a pressure rating high enough to allow pressure testing, such as, for example, factory acceptance testing or field installation pressure testing, to take place but low enough to rupture at a pre-determined maximum allowable pressure based on design temperature input for in-service conditions.

In one embodiment, wellbore fluid or sea water may be at a first temperature when it becomes trapped in void 272. The temperature of the fluid in void 272 may increase when, for example, high temperature wellbore fluid begins flowing up through wellbore (not shown) to a tree outlet (not shown) located below lower crown plug 254. The increased temperature may cause thermal expansion of the fluid trapped in void 272. If the pressure within void 272 exceeds the maximum allowable pressure for rupture disc 288, rupture disc 288 will yield and allow the fluid to move through passage 280 to port 282. The fluid will then exit port 282 and flow past BPS 258 and u-seal 266 to the wellbore through passage 252. Rupture disc 288 may be used alone, with restriction valve 160, or vacuum puller 200.

While the invention has been shown or described in only some of its forms, it should be apparent to those skilled in the art that it is not so limited, but is susceptible to various changes without departing from the scope of the invention.

What is claimed is:

1. A subsea production tree, comprising:

a tree block having a cylindrical bore;

an inner wellhead assembly mounted in the tree block and having an axial passage relative to an axis of the cylindrical bore;

a first plug configured to sealingly engage the axial passage at a first location;

a second plug configured to sealingly engage the axial passage at a second location, the second location being spaced axially apart from the first location;

wherein the axial passage, the first plug, and the second plug define a cavity, the cavity having a first volume and being adapted to retain a trapped fluid;

a vent passage extending through the second plug and in fluid communication with the cavity, the vent passage being adapted to flow at least a portion of the trapped fluid from the cavity;

a pressure relief member blocking the vent passage, wherein the pressure relief member is adapted to permit flow through the vent passage when the pressure in the cavity exceeds a predetermined value; and a first annular seal and a second annular seal, the first and second annular seal having the same diameter and being axially adjacent to each other, the vent passage terminating between the first and second annular seals, the first annular seal blocking downward flow in the axial passage and the second annular seal blocking upward flow in the axial passage but not downward flow, so as to allow fluid from the cavity to flow past the second annular seal.

2. The subsea production tree according to claim 1, wherein the vent passage is in fluid communication with a wellbore.

3. The subsea production tree according to claim 1, wherein the axial passage leads to a wellbore.

4. The subsea production tree according to claim 1, further comprising:

a second vent passage in communication with the cavity;

a seat formed in the second vent passage;

a valve member having a sealing surface that engages the seat, the valve member having a longitudinal axis and being accessible from an exterior of the subsea production tree; and wherein the valve member is movable axially to an open position, a restricted position, and a closed position, the open position permitting a fluid to flow through the second vent passage at a first rate, the restricted position permitting fluid to flow through the second vent passage at a second rate, the second rate being smaller than the first rate, and the closed position stopping fluid flow.

5. The subsea production tree according to claim 1, wherein the inner wellhead assembly comprises a tubing hanger and a tree cap, the first plug being configured to land in and sealingly engage the axial passage within the tree cap and the second plug being configured to land in and sealingly engage the axial passage within the tubing hanger.

6. The subsea production tree according to claim 1, wherein the first and second annular seal are each positioned between an outer diameter surface of the second plug and an inner diameter surface of the axial passage.

7. The subsea production tree according to claim 1, further comprising:

a second vent passage in communication with the cavity;

a seat formed in the second vent passage;

a valve member having a sealing surface that engages the seat, the valve member having a longitudinal axis and being accessible from an exterior of the subsea production tree; and wherein the valve member is movable axially to an open position and a closed position, the open position permitting a fluid to flow through the second vent passage and the closed position stopping fluid flow.

8. In a wellhead assembly having an axial passage, a first plug located in and sealingly engaging the axial passage, a second plug located in and sealingly engaging the axial passage, the second plug being spaced axially apart from the first plug, wherein the axial passage, the first plug, and the second plug define a cavity, the cavity being adapted to retain a trapped fluid between the first and second plugs, an apparatus for relieving pressure in the cavity, comprising:

a vent passage extending through the second plug and in fluid communication with the cavity, the vent passage being adapted to flow at least a portion of the trapped fluid from the cavity;

a first annular seal and a second annular seal, the first and second annular seal having the same diameter and being axially adjacent to each other, the vent passage terminating between the first and second annular seals, the first annular seal blocking downward flow in the axial passage and the second annular seal blocking upward flow in the axial passage but not downward flow, so as to allow fluid from the cavity to flow past the second annular seal.

9. The wellhead assembly according to claim 8, further comprising a pressure relief member blocking the vent passage, wherein the pressure relief member is adapted to permit flow through the vent passage when the pressure in the cavity exceeds a predetermined value.

10. The subsea production tree according to claim 8, wherein the first and second annular seal are each positioned between an outer diameter surface of the second plug and an inner diameter surface of the axial passage.

11. A wellhead assembly, comprising:

an axial passage;

a first plug configured to sealingly engage the axial passage at a first location;

a second plug configured to sealingly engage the axial passage at a second location, the second location being spaced axially apart from the first location;

wherein the axial passage, the first plug, and the second plug define a cavity, the cavity having a first volume and being adapted to retain a trapped fluid;

a vent passage extending through the second plug and in fluid communication with the cavity, the vent passage being adapted to flow at least a portion of the trapped fluid from the cavity; and a first annular seal and a second annular seal, the first and second annular seal having the same diameter and being axially adjacent to each other, the vent passage terminating between the first and second annular seals, the first annular seal blocking downward flow in the axial passage and the second annular seal blocking upward flow in the axial passage but not downward flow, so as to allow fluid from the cavity to flow past the second annular seal.

12. The wellhead assembly according to claim 11, further comprising a pressure relief member blocking the vent passage, wherein the pressure relief member is adapted to permit flow through the vent passage when the pressure in the cavity exceeds a predetermined value.

13. The subsea production tree according to claim 11, wherein the first and second annular seal are each positioned between an outer diameter surface of the second plug and an inner diameter surface of the axial passage.

* * * * *